US010988971B1

(12) United States Patent
Annazone, Jr. et al.

(10) Patent No.: US 10,988,971 B1
(45) Date of Patent: Apr. 27, 2021

(54) ROLLER GUIDE FOR POCKET DOORS

(71) Applicants: Peter J. Annazone, Jr., Alva, FL (US); Niko A. Annazone, Fort Myers, FL (US)

(72) Inventors: Peter J. Annazone, Jr., Alva, FL (US); Niko A. Annazone, Fort Myers, FL (US)

( * ) Notice: Subject to any disclaimer, the term of this patent is extended or adjusted under 35 U.S.C. 154(b) by 254 days.

(21) Appl. No.: 16/241,367

(22) Filed: Jan. 7, 2019

(51) Int. Cl.
*E06B 3/46* (2006.01)
*E05D 15/06* (2006.01)

(52) U.S. Cl.
CPC ..... *E06B 3/4654* (2013.01); *E05D 15/0626* (2013.01); *E05Y 2900/14* (2013.01)

(58) Field of Classification Search
CPC ..... E06B 3/4654; E05Y 29/132; E05Y 29/14; E05D 15/0669; E05D 15/0656; E05D 15/066; E05D 15/063
See application file for complete search history.

(56) References Cited

U.S. PATENT DOCUMENTS 1,878,214 A * 9/1932 Wego ..... F16C 33/76 384/477
1,925,165 A * 9/1933 Zimmerman ..... E05F 17/001 49/16
2,202,209 A * 5/1940 Kennedy ..... A47B 88/487 312/334.15
2,255,290 A * 9/1941 Kennedy ..... A47B 88/487 312/334.39
2,255,314 A * 9/1941 Graham ..... F16H 7/20 384/546
2,717,814 A * 9/1955 Archer ..... B65G 39/02 384/510
2,834,069 A 5/1958 Perrone
3,058,174 A 10/1962 Sterling
3,112,960 A * 12/1963 Hillson ..... A47B 88/487 384/19
3,266,189 A * 8/1966 Eby ..... E06B 3/5072 49/152
3,269,060 A * 8/1966 Kessner ..... E06B 3/50 49/264
3,283,358 A * 11/1966 Merriam ..... B60B 33/0028 16/20
3,300,897 A * 1/1967 Wikkerink ..... E06B 3/5072 49/137
3,400,490 A * 9/1968 Anderson ..... E05D 15/06 49/372

(Continued)

FOREIGN PATENT DOCUMENTS

JP 3550323 4/2004
KR 20-0438445 2/2008

OTHER PUBLICATIONS https://www.ebay.com/itm/8-Types-Wall-Mount-Floor-Bottom-Guide-Sliding-Barn-Door-Stay-Roller-Hardware-/232862395309.

*Primary Examiner* — Justin B Rephann
(74) *Attorney, Agent, or Firm* — Loeffler IP Group, P.A.; Bryan L. Loeffler, Esq.

(57) ABSTRACT

A roller guide (1) for a pocket door comprising a roller (16) supported by two angled support arms (10, 13) extending from a base plate (2). The roller guide may be mounted adjacent to a pocket door so the roller makes contact with a surface of the pocket door and prevents the pocket door from scraping against an opening of a wall in which the pocket door is slideably mounted.

1 Claim, 3 Drawing Sheets

(56) References Cited

U.S. PATENT DOCUMENTS

| | | | | | |
|---|---|---|---|---|---|
| 3,619,947 | A * | 11/1971 | Burum | E05D 15/0669 | 49/265 |
| 3,716,890 | A * | 2/1973 | Benson | E05D 15/0669 | 16/91 |
| 4,054,964 | A * | 10/1977 | Kaneko | A45C 5/14 | 16/20 |
| 4,095,853 | A * | 6/1978 | MacDonald | A47B 88/41 | 384/19 |
| 4,620,801 | A * | 11/1986 | MacDonald | A47B 88/487 | 384/19 |
| 4,794,669 | A * | 1/1989 | Sanders | E05D 11/1057 | 16/341 |
| 6,058,655 | A * | 5/2000 | Gravel | B60P 7/14 | 49/306 |
| 6,250,016 | B1 * | 6/2001 | Gravel | B60P 7/14 | 49/306 |
| 6,594,856 | B1 * | 7/2003 | Cherukuri | B60B 33/0005 | 16/32 |
| 9,897,332 | B2 * | 2/2018 | Glover | E06B 9/24 | |
| 10,689,893 | B2 * | 6/2020 | Selvaag | E05D 15/06 | |
| 2008/0134583 | A1 | 6/2008 | Polus | | |
| 2015/0107580 | A1 * | 4/2015 | Weber | F24S 40/80 | 126/600 |

* cited by examiner

ROLLER GUIDE FOR POCKET DOORS

FIELD OF THE INVENTION

This invention relates to hardware for mounting sliding pocket doors and more particularly a roller guide that maintains a pocket door in a centered position within a door frame, thereby preventing sides of the pocket door from coming into contact with the door frame.

BACKGROUND OF THE INVENTION

Sliding doors, also known as pocket doors, are well known for use in spaces where there is insufficient space for opening a hinged door.

Typically, a pocket door is mounted within a rough opening provided in a non-bearing partition wall, adjacent to a doorway. In such a system, it is common to suspend the pocket door on a track assembly from which the pocket door hangs and slides on. The doorway is opened by rolling the pocket door into a pocket formed by an outer door assembly and wall surface covering. Similarly, the doorway may be closed by rolling the pocket door from the pocket into the doorway.

As the pocket door is rolled into and out of the recessed storage area within the wall, it passes through a narrow rectangular opening. For many reasons, such as expansion, warping, damage to mounting hardware and so forth, front and rear surfaces of a pocket door may rub against the narrow rectangular opening. This rubbing damages the surfaces of the pocket door.

Therefore, a need exists for a roller guide that maintains a pocket door in a centered position within a door frame, thereby preventing sides of the pocket door from coming into contact with the door frame.

SUMMARY OF THE INVENTION

The primary object of the present invention is to provide a roller guide that maintains a pocket door in a centered position within a door frame, thereby preventing sides of the pocket door from coming into contact with the door frame.

The present invention fulfills the above and other objects by providing a roller guide for a pocket door comprising a roller supported by two angled support aims extending from a base plate. The roller guide may be mounted adjacent to a pocket door so the roller makes contact with a surface of the pocket door and prevents the pocket door from scraping against an opening of a wall in which the pocket door is slideably mounted.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
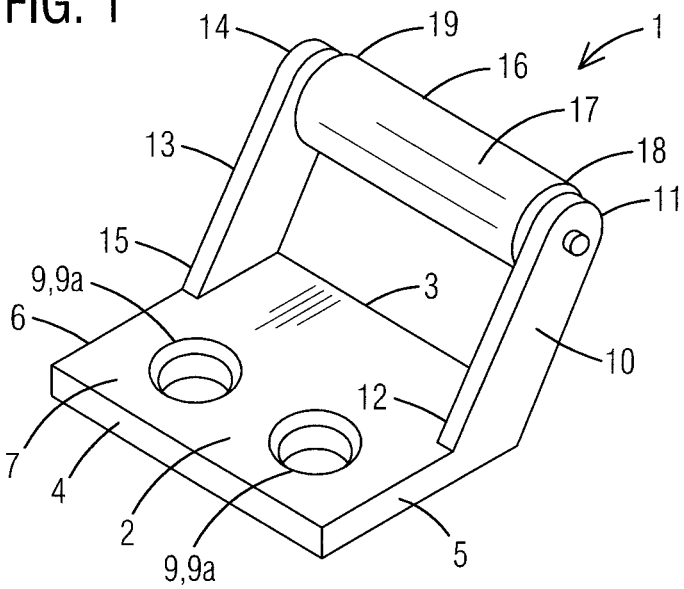
FIG. 1 is a perspective top view of a roller guide of the present invention.
Figure 2:
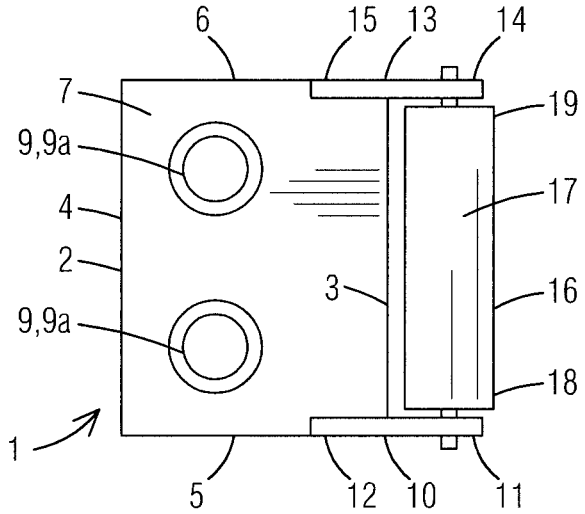
FIG. 2 is a top view of a roller guide of the present invention.
Figure 3:
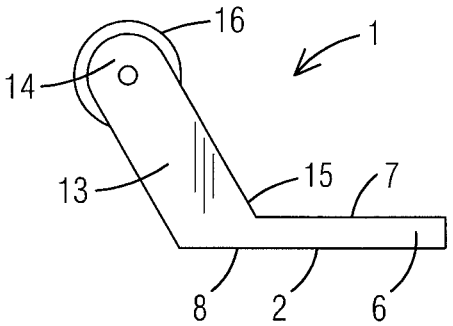
FIG. 3 is a left side view of a roller guide of the present invention.
Figure 4:
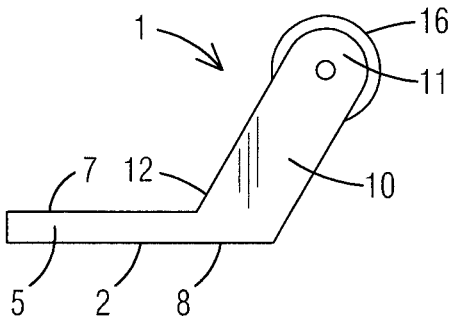
FIG. 4 is a right side view of a roller guide of the present invention.
Figure 5:
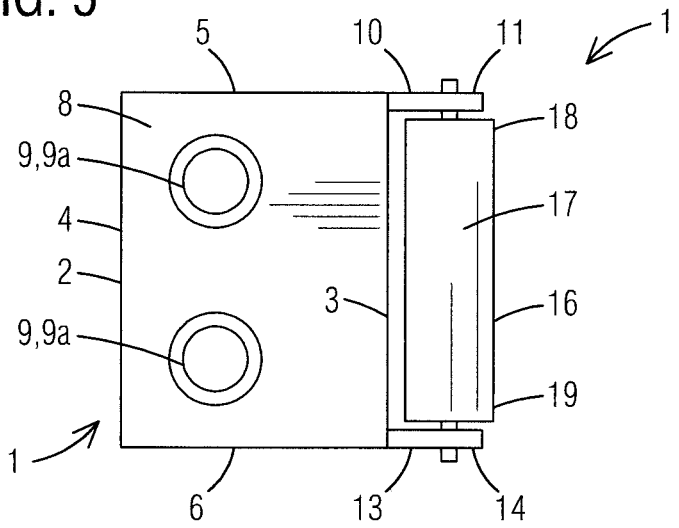
FIG. 5 is a bottom view of a roller guide of the present invention.

For purposes of describing the preferred embodiment, the terminology used in reference to the numbered accessories in the drawings is as follows:

1. roller guide, generally
2. base plate
3. front edge of base plate
4. rear edge of base plate
5. right side edge of base plate
6. left side edge of base plate
7. top surface of base plate
8. bottom surface of base plate
9. attachment means
9*a*. aperture
9*b*. screw
10. right support arm
11. proximal end of right support arm
12. distal end of right support arm
13. left support arm
14. proximal end of left support arm
15. distal end of left support arm
16. roller
17. outer surface of roller
18. right side of roller
19. left side of roller
20. pocket door
21. doorway
22. wall
23. opening of wall
24. right side of opening
25. left side of opening
26. trim
27. right side surface of pocket door
28. left side surface of pocket door With reference to FIGS. 1-5, a roller guide 1 of the present invention is illustrated. The roller guide 1 of the present invention comprises a preferably rectangular-shaped base plate 2 having a front edge 3, rear edge 4, right side edge 5, left side edge 6, top surface 7 and bottom surface 8. The base plate 2 may be mounted to a surface using an attachment means 9, such as one or more screws that engage apertures 9*a* located on the base plate 2, an adhesive and so forth. A right support arm 10 having a proximal end 11 and a distal end 12 extends from the right side edge 5 of the base plate 2 at a substantially perpendicular angle in relation to the front edge 3 and the rear edge 4 of the base plate 2. In addition, the right support arm 10 preferably extends from the base plate 2 at a slanted angle in relation to the right side edge 5, thereby extending the distal end 12 of the right support arm 10 over the front edge 3 of the base plate 2. Likewise, a left support arm 13 having a proximal end 14 and a distal end 15 extends from the left side edge 6 of the base plate 2 at a substantially perpendicular angle in relation to the front edge 3 and the rear edge 4 of the base plate 2. The left support arm 13 preferably extends from the base plate 2 at a slanted angled in relation to the left side edge 6, thereby extending the distal end 15 of the left support arm 13 over the front edge 3 of the base plate 2.

A cylindrical-shaped roller 16 having an outer surface 17, a right side 18 and a left side 19 is located between the distal end 12 of the right support arm 10 and the distal end 15 of the left support arm 13 and rotates via at least one axle 19 extending from the right side 18 of the roller 16 and the left side 19 of the roller 16. Said at least one axle 19 being attached to the distal end 12 of the right support arm 10 and the distal end 15 left support arm 13, thereby allowing the roller 16 to rotate independently of the right support arias 10, the left support arm 13 and the base plate 2. The distal end 12 of the right support arm 10 and the distal end 15 of the left support arm 13 are each preferably rounded and the outer surface 17 of the roller 16 extends beyond said distal end 12 of the right support arm 10 and the distal end 15 of the left support arm 13, thereby allowing the roller 16 to make full contact with a surface without interference from the distal end 12 of the right support arm 10 and the distal end 15 of the left support arm 13.

Figure 6:
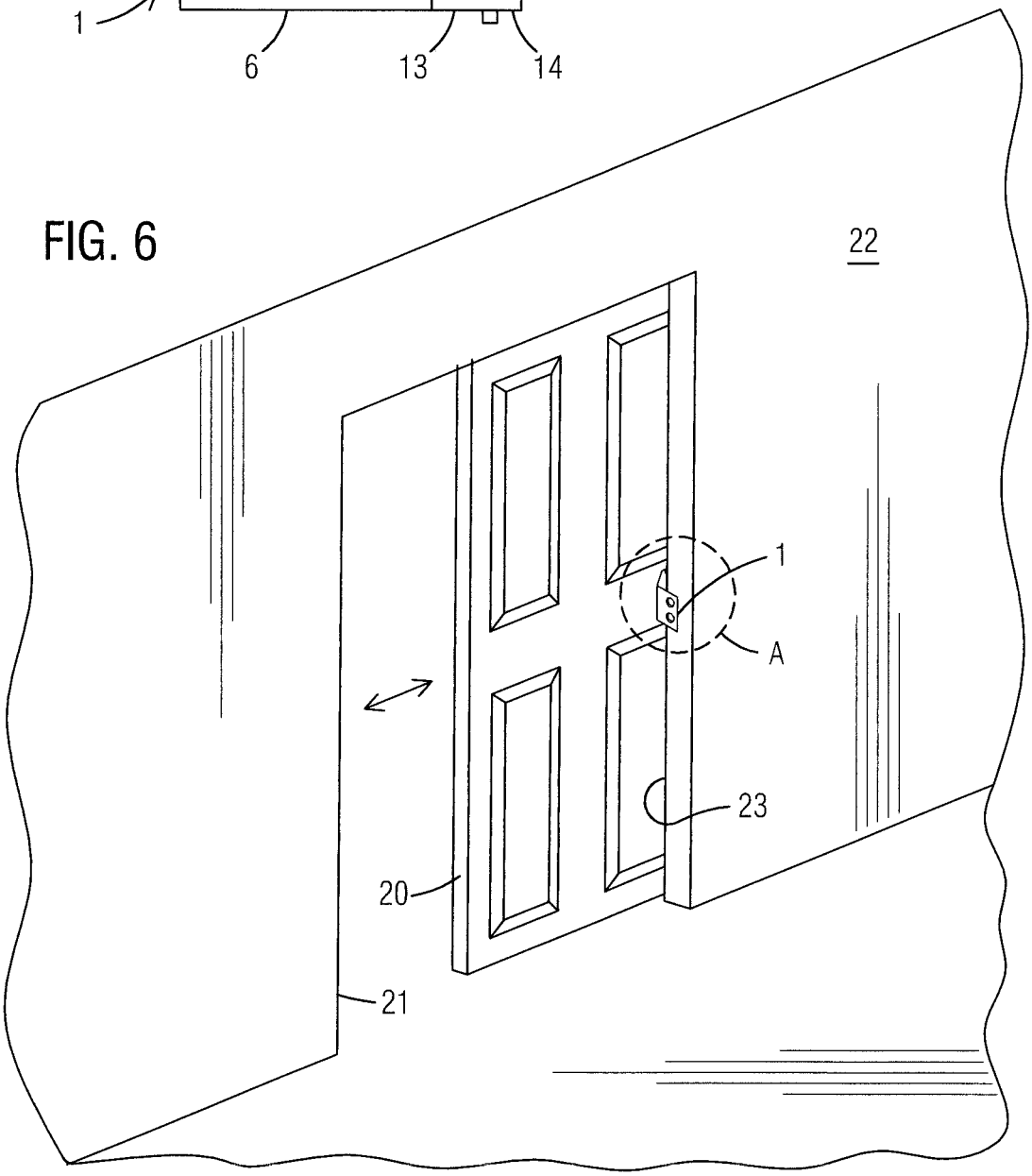
FIG. 6 is a perspective view of a pocket door assembly wherein a pocket door installed in a doorway in a wall and in a partially open position extending out of an opening in the wall.

With reference to FIG. 6, a perspective view of a pocket door assembly wherein pocket door 20 installed in a doorway 21 in a wall 22 and in a partially open position extending out of an opening 23 in the wall 22 is illustrated. Roller guides 1 of the present invention are installed adjacent to the pocket door 20 to prevent the pocket door 20 from making contact with the wall 22.

Figure 7:
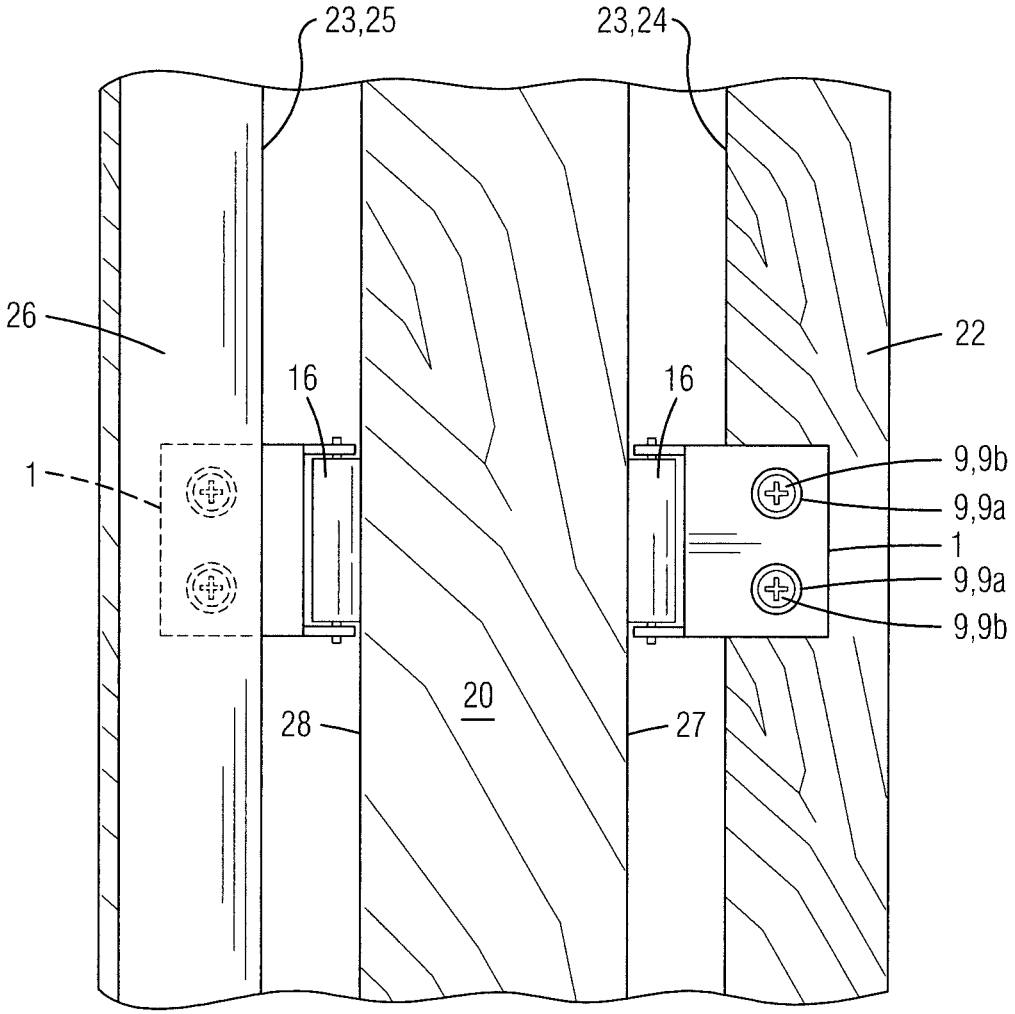
FIG. 7 is a side view of the pocket door of FIG. 6 along lines A-A wherein the pocket door is in a closed position within the wall.

With reference to FIG. 7, a side view of the pocket door 20 of FIG. 6 along lines A-A wherein the pocket door 20 is in a closed position within the wall 22 is illustrated. The pocket door 20 normally hangs vertically centered within the opening 23 of the wall 22. The opening 23 of the wall 22 comprises a right side 24 and a left side 25. As illustrated herein, the right side 24 of the opening 23 and the wall 22 is covered by trim 26. The left side 24 of the opening 23 and the wall 22 is left rough and exposed. As illustrated on the left side 24 of the opening 23, a first roller guide 1 of the present invention is installed with the base plate 2 attached to the left side 24 of the opening 23 via an attachment means 9, such as one or more screws 9*b* that engage apertures 9*a* located on the base plate 2. The roller 16 extends partially into the opening 23 and the wall 22 and makes contact with a right side surface 27 of the pocket door 20. Likewise, a second roller guide 1 of the present invention is installed with the base plate 2 attached to the right side 24 of the opening 23. However, the base plate is not visible due to the fact that it has been covered by trim 26. The trim 26 and/or the side 24 of the opening 23 may be notched to allow the base plate 2 to be recessed, thereby allowing the trim 26 to sit flush. The roller 16 of the second roller guide 1 extends partially into the opening 23 and the wall 22 and makes contact with a left side surface 28 of the pocket door 20. The roller guides 1 of the present invention are installed adjacent to the pocket door 20 to prevent the pocket door 20 from making contact with the wall 22 and/or trim 26.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

We claim:

1. A pocket door assembly having roller guides comprising:

a rectangular shaped pocket door located within a wall opening having a right side and a left side;

a first roller guide attached to the right side of the wall opening;

a second roller guide attached to the left side of the wall opening;

said first roller guide having a substantially rectangular-shaped base plate having a front edge, a rear edge, a right side edge, a left side edge, a top surface and a bottom surface;

said first roller guide having a right support arm having a proximal end and a distal end extending from the right side edge of the base plate;

said first roller guide having a left support arm having a proximal end and a distal end extending from the left side edge of the base plate;

said first roller guide having a cylindrical-shaped roller having an outer surface, a right side and a left side is located between the distal end of the right support arm and the distal end of the left support arm;

at least one axle being rotatably connected to the distal end of each support arm;

said second roller guide having a substantially rectangular-shaped base plate having a front edge, a rear edge, a right side edge, a left side edge, a top surface and a bottom surface;

said second roller guide having a right support arm having a proximal end and a distal end extending from the right side edge of the base plate;

said second roller guide having a left support arm having a proximal end and a distal end extending from the left side edge of the base plate;

said second roller guide having a cylindrical-shaped roller having an outer surface, a right side and a left side located between the distal end of the right support arm and the distal end of the left support arm; and at least one axle being rotatably connected to the distal end of each support arm.

* * * * *